United States Patent [19]

Linzberger et al.

[11] 4,339,083

[45] * Jul. 13, 1982

[54] APPARATUS FOR THE GRINDING OF CEREAL

[75] Inventors: Robert Linzberger, Abtwih; Leendert Ketting, Oberuzwil; Ernst M. Heer, Zuzwil, all of Switzerland

[73] Assignee: Gebrueder Buehler AG, Uzwil, Switzerland

[ * ] Notice: The portion of the term of this patent subsequent to Feb. 20, 1996, has been disclaimed.

[21] Appl. No.: 141,903

[22] Filed: Apr. 21, 1980

Related U.S. Application Data

[63] Continuation of Ser. No. 1,071, Jan. 5, 1979, abandoned, which is a continuation of Ser. No. 815,559, Jul. 14, 1977, Pat. No. 4,140,285.

[51] Int. Cl.[3] ..... B02C 4/06; B02C 4/32

[52] U.S. Cl. ..... 241/37; 241/232

[58] Field of Search ..... 241/6, 30, 37, 67, 230–234, 241/285 R

[56] References Cited

U.S. PATENT DOCUMENTS

| | | | |
|---|---|---|---|
| 2,650,034 | 8/1953 | Wiemer | 241/67 |
| 2,659,154 | 11/1953 | Rendel | 241/37 UX |
| 2,671,616 | 3/1954 | Fielden | 241/233 |
| 2,805,028 | 9/1957 | Linden | 241/231 X |
| 3,292,869 | 12/1966 | Beyeler | 241/37 |
| 3,372,878 | 3/1968 | Verdier | 241/37 X |
| 3,509,815 | 5/1970 | Lloyd | 241/37 X |
| 3,587,986 | 6/1971 | Alciati | 241/231 |
| 4,062,500 | 12/1977 | Peterson | 241/285 R |

FOREIGN PATENT DOCUMENTS

| | | | |
|---|---|---|---|
| 2413956 | 9/1974 | Fed. Rep. of Germany | 241/37 |

*Primary Examiner*—Howard N. Goldberg
*Attorney, Agent, or Firm*—Oblon, Fisher, Spivak, McClelland & Maier

[57] ABSTRACT

Apparatus for grinding cereal grain involving the controlling of grinding forces between a pair of cooperating grinding rolls, by determining the actual grain receiving gap between the rolls during rotation thereof and regulating the gap in accordance with a preset desired dimension. A pair of parallel grinding rolls are mounted for movement of one roll relative to the other in a generally radial direction. One of the rolls is yieldingly biased toward engagement with the other roll. Adjustment mechanism is operative to limit movement of the bias roll toward said other roll and to establish said preset dimension or gap between the rolls.

25 Claims, 10 Drawing Figures

APPARATUS FOR THE GRINDING OF CEREAL

This is a continuation, of application Ser. No. 1,071, filed Jan. 5, 1979, now abandoned, which is a continuation of Ser. No. 815,559, 7/14/77 now U.S. Pat. No. 4,140,285.

The invention relates to an apparatus for the grinding and breaking of cereal.

Although, in flour milling, grinding is primarily a comminuting function, it is generally recognised that in the production of flour and semolina the grinding of the cereal and its intermediate products is the most important operation but above all the most difficult.

The reliability of the grinding effect determines the pattern of this relatively complicated and highly sophisticated process, and this has an effect on the quality and the extraction, for example in white flours.

From the specific problems and requirements regarding the production of the flour and semolina from cereal and similar products, an independent category of mills has been developed, the so-called milling industry roller mill, which concerns a quite specific grinding technique contrasting for example with the grinding technique used on ores, the production of flakes from vegetable raw materials, etc.

Reference will first of all be made hereinafter to an article by Dr. H. Gliesberg in "The mill and the mixed feed industry" of Mar. 18, 1976, which in pages 147–149 gives a brief historical review of the roller mill used in the milling industry. The last paragraph of the article is presumably generally recognised at the present day in the technical world:

"The opinion expressed by Moog (1953) on the roller mill discovered by Wegmann in 1876 and then improved by Mechwart is still valid at the present day: it is the prototype! What happens from now on are simply details!"

Wegmann was the inspired inventor of the category of the roller mill proper, from which the two variants constituted by the fluted roll mill and the smooth roll mill developed.

In the last column of the said article, foot of page 148, it is specifically stated: "The patent application filed by Wegmann on Mar. 9, 1876 can be regarded as one of the most important and historical documents in the modern milling industry. The claim of that patent reads in full:

(a) The use of fluted rolls with a shearing action for the comminuting of wheats and other cereals with a great difference in the circumferential speeds, in fact in a ratio of more than 1:2 or one mobile roll or one fixed roll, the latter being possibly also replaced by a differently shaped body likewise fluted, for example a plate, . . ."

"The porcelain roller mill was actually intended in the first instance by its inventor simply for the reduction of semolinas. Wegmann's system from the beginning aimed at not continuing to disintegrate the cereal as in the case of stone mills, but to crush the breaks and semolinas and thus obtain the pieces of bran in as undamaged a state as possible and in as large pieces as possible in the material being ground. They were then removed by bolting and cleaning (Luther). "Moog amplified these remarks as follows: "He (Wegmann) has carried through the far-reaching principle that the material being ground is dressed after each individual passage, since in this way there is a saving in power, the semolinas are not injured, and white flours are obtained. This means a reduction in the grinding travel to the shortest period, only a single action by the rolls reduction of the rolling work to a minimum."

Wegmann in his invention at one crucial point in fact based his method on the grinding technique practised for many thousands of years, since according to his teaching the grinding work is to be carried out between a stationary body (fixed bottom stone=fixed roll) and a mobile body (upper stone or runner=mobile roll).

In his article, Gliesberg continues: "Whereas Wegmann developed his porcelain roller mills successfully, Mechwart now devoted himself entirely to the further development of the Wegmann mill. Primarily he aimed at using rolls which were chilled castings instead of the porcelain, at first only for the smooth reduction rolls for the semolinas, but later on also for the obliquely fluted break rolls. It must never be overlooked, however, that all the improvements partly but into practice first of all by Mechwart are based in the last resort on the inspired ideas of Friedrich Wegmann set down in the patent of Mar. 9, 1876."

The theoretical maximum extraction of white flours is assumed to be about 82.5%. At the time, Wegmann gave a yield or extraction rate of 47%. For outside people the extremely high extraction values of 70–75% which are reached at the present day with regard to white flours are just not comprehensible if it is considered what a very complicated construction a cereal grain has, and also its special shape with furrows etc.

A pre-requisite for the high extraction rates achieved in recent years, apart from the other method steps before and after grinding, has been a continually improved control of the special grinding process.

The grinding gap when grinding with smooth rolls is set to 6–10/100 mm as a lower value. A modification of the value by a thousandth of a millimeter already exerts an influence of 1% from the geometry point of view. With a break roll mill the gap sizes during grinding amount to about 1/10–1 mm.

In practice, these very high requirements are met by producing only individual components, particularly the pair of rolls to the highest standards of precision. A roll is fitted in a fixed situation in a rigidly constructed housing. The grinding gap, or the free roll, is adjusted by an adjusting device attached to the housing. The system of forces in the grinding gap is closed by way of the housing. "Precision" grinding has been achieved for many decades because on the one hand specific conditions have been provided with regard to the conducting of the product etc and fine setting values, and more particularly the grinding work, the product after grinding, is continually monitored; and if there is a deviation from empirically ascertained relationship, it is taken as a measure for the modification of the setting values. The continual monitoring of the product after grinding is a typical feature of flour milling. There are very many influencing factors to be considered, the temperature, the moisture, the intake period and appropriate heating of the entire machine, etc. In addition, it is in fact a living substance which is being processed, which in any case has its own large number of variations. Not the least important feature is a good knowledge of the process on the part of the operators, for dealing with and as far as possible controlling all the factors. In recent years in fact sensory testing methods have again been appreciated and in some case also required. This may be one of the main reasons why it has not been possible to put into actual practice the wish expressed for many years to automate an entire mill.

The British Pat. No. 1 415 604 can be mentioned as the most recent example of an automated mill. In that publication it is proposed to ascertain the behavior and operation of each roller mill with a computer by monitoring the downstream screens, so as to control the roller mills used or modify the spacings of their rolls if deviations occur from a predetermined scheme. In theory, this method is practicable. For practical execution, probably a period of time of at least one to two decades will be necessary to fully develop a new computerized mill to the point of a completely finalized installation. One of the great errors may be this proposal is that control and monitoring for the actual grinding operation are aimed at with the use of an increasingly roundabout way, although a mechanical way, with the result that the already very complex operation of the process is still more complicated. Sensory tests are also necessary, so that in a computerized mill it would also be necessary to appoint in addition to the head miller an additional expert, a computer expert, who would carry out the continual program changes. The disadvantages of the previous grinding process are not eliminated but simply corrected by a roundabout way.

The invention has as its object to develop a grinding and breaking apparatus which allows better and more simple control of the grinding operation and as far as possible obviates disturbing influences from the outside and towards the outside.

The solution proposed by the present invention is characterized in that the forces within the grinding gap between the two rolls of a pair of rolls are directly influenced and/or regulated.

The idea according to the invention thus provides a quite new way for the grinding of cereal and more particularly makes it possible to obviate very many disadvantages of the previous grinding process more particularly with various preferred constructional forms.

The invention also concerns a roller mill for carrying out the method, with one or more pairs of smooth or fluted rolls, the rolls of a pair of rolls having different circumferential speeds, for example 1:25, 1:1.5, 1:2.6, 1:3.5.

It is an object of the invention to provide a solution which allows the grinding work to be improved without having to accept the necessity to tolerate the disadvantages which are unavoidable if the hitherto known method is continued with, more particularly still greater additional constructional outlay.

The solution proposed by the invention is also intended to make improvements in the following component objects or at least make them possible:

Improved output
Reproducible grinding conditions
Reduction in noise
Overall stable grinding conditions The invention is characterised in that the pair of rolls or each pair of rolls is supported on a base as a roll assembly forming a closed system of forces with the grinding gap adjusting device.

With the solution proposed by the invention also, the shearing action for the comminuting of wheats and other cereals with a great difference in the circumferential speeds of the two rolls continues to be valid as a basis for breaking and grinding. But the proposed solution for the construction points a new way of development with regard to the idea of the fixed roll. The expression "fixed" is no longer understood in the hitherto understood sense of "immovable" like the stationary bottom stone in a stone mill. The core of the invention is the deliberate co-operation in a closed pattern of forces of the two grinding rolls with the adjusting devices, supported as a roll assembly on a base.

Not only has it been possible to achieve the basic object of the invention, but quite new positive effects, which the person skilled in the art would not have expected, have been achieved. External influences can be kept away from the grinding work. Oscillations occur to a reduced extent, and as a result the entire rolling mill gives off much less noise towards the exterior. The action of forces in the two grinding rolls remains limited to the smallest possible circle.

It has been possible to show, to the surprise of experts, that by restricting the number of elements which have an influence on the behavior of the two rolls, the action of forces during the grinding operation can be controlled in a better way. It ispossible to dispense with an expensive and heavy housing construction. The base can be given a very simple construction since it no longer has any influence on the forces in the grinding gap. As compared with a conventional solution, the invention gives a more stable behavior of the rolls and allows a more deliberate influence on the absolute value of the grinding gap and the behavior in the co-operation of the two rolls forming a pair of rolls.

Hitherto the particular arrangement of the roll housing was a determining factor for the behavior of the rolls and the particular setting of the grinding gap. A discussion will now follow of various very advantageous features of the invention.

In a preferred constructional form a product collecting hopper is connected directly to the base. In the overall design of mills a pneumatic suction removal apparatus has been found the best solution for very many cases, and the pneumatic suction line is connected directly to the collecting hopper. Collecting hoppers consist of parts of large surface area which, as is known, transmit oscillations relatively strongly. Therefore, the separation of roll housing and roll assembly as regards forces is particularly advantageous in this respect. Preferably a damping intermediate layer is arranged between the roll assembly unit and the base.

Even the inventors were surprised at the effect which could be achieved by the damping intermediate layer as regards vibration problems, but particularly with regard to reducing noise. Without providing special precautions, it was possible to reduce the noise by a value of the order of 5 decibels, which is considerable in relation to the necessary additional constructional outlay. Good values are obtained already with flat intermediate layers consisting more particularly of material which is not very elastic.

The noise problem is also particularly important in milling industry roller mills since usually there are a large number of roller mills in the same room, and frequently for example 15–30 roller mills are arranged on one floor.

In the technical world, the opinion is still very widespread that a heavy massive rolling mill structure is the best, more particularly as regards the conventional roll housings. From the practical point of view the reasoning is only partly accurate, although the argument put forward by the practical designer that only with a massive construction is it possible to meet the high requirements of the roller mill, maintaining predetermined grinding gap settings, is not simple to refute. But the defect in this line of argument is that steel or cast iron is in itself an elastic material in contrast for example to the stone used in the old stone mills. The elasticity, that is to say a greater or less amount of yielding of the steel construction when subjected to various loads, is a natural feature in the known roller mills.

In the preferred constructional form a per se known foreign body safety arrangement is arranged in the closed system forces roll assembly. For this purpose a spring pack is fitted which is preloaded to a higher value than the application pressure of the grinding rolls.

In known mills, the individual elasticities of the housing construction, adjusting devices, bearing holders, grinding rolls etc. add up to a specific spring characteristic for the co-operation of two rolls for each make of roller mill. Each make of roller mill has a different spring characteristic because of the different construction. Now it has been found that the "softness" of the system has a strong influence on grinding conditions. This state of affairs is one of the reasons why each roller mill gives different grinding results.

In a particularly advantageous constructional form of the invention, means for varying the spring characteristic are provided at the two bearing end portions of the operative interconnection unit of the roll assembly.

Because of this feature it is possible to show completely new inter-relationships in the grinding art for cereals, and it gives the necessary construction conditions for optimum grinding. Hitherto the industry has been limited to achieving the maximum control of grinding gap, grinding gap adjusting devices, more particularly the problems of parallel adjustment of the rolls of a pair of rolls, roll surface, the properties of the grinding rolls, such as strength, metallurgical questions, heat problems etc. How hard or how soft the cooperation of the rolls of a pair of grinding rolls was, was in a sense a business secret of each roll producer. If the mill design is designed for a specific grinding work, the given spring characteristic is not disadvantageoous. But, as is known in competitive production, use etc., firms do not aim at maximum targets but optimum targets. This means that compromises have to be made in many cases. This is also true of roller mill construction for the grinding of cereal. It is only the possibility of varying the spring characteristic of the roll assembly, and in the co-operation of the two rolls of a pair of grinding rolls which have resulted in the completely new discoveries that the spring characteristic must be a function of the size of the grinding gap and the grinding pressure, or the desired fineness of the grinding effect. The smaller the grinding gap, the softer is to be, in principle, the spring charactertistic of the two grinding rolls co-operating with one another. Thus a further important factor has been found which allows more uniform grinding work, as a result of more harmonious co-operation of all the forces, and more particularly heat problems also, and corresponding resonance build-ups due to the mutual influences of all the forces acting directly on the grinding gap.

The means for varying the spring characteristic may be constructed in various ways.

For example it is possible to select an arm of the adjusting devices as the elastic element. For various uses, in this case at least two different interchangeable arms could be provided. In actual practice usually more arms, but at least three or four different arms would be necessary in order to make it possible to obtain a deliberate influence on the main factors in grinding and breaking. Although this way is theoretically possible, it is not so preferable since the customer would be unwilling to carry out the changing of an arm.

The desired elasticity in the greater number of cases is of the order of magnitude of a few hundredths or tenths of a millimeter. In cases where no modification in the spring characteristic of the mill is desired, the system of interchangeable, appropriately thin expansion bars or members would probably be found very advantageous. Depending on requirements the manufacturer can build into the construction for each mill a suitable expansion member as a link connecting the two rolls of a pair of rolls. The expansion member represents the variable spring means, and here again a set of different expansion values must be kept ready or available for selection, corresponding to a set of different gear wheels.

It has been found very advantageous to use a true spring, more particularly a cup spring, as the means for varying the spring characteristic. A cup spring, as is known, makes it possible by varying the arrangement and number of individual cup springs, to put together a very large range of different spring characteristics.

It has been found particularly advantageous to combine an expansion rod and a cup spring. In this case a single expansion member is sufficient. It must be pointed out that the spring characteristic effective for the grinding operation results from the total of all the parts of the roll assembly forming the closed forces system unit, and a not unimportant part resides in the elastic deformation of the rolls themselves. The core of the feature of the invention resides in the fact that means are provided for varying the spring characteristic or respectively modifying the characteristic in the same mill, this being possible at all without requiring great constructional changes.

Already with the first experimental roller mill it was possible to show that in the deliberate adaptability of the spring characteristic it was possible to make a very great step forward with regard to better control of grinding, and the grinding operation as a whole is more stable. An at least equal advantage resides in the production of the roll mechanism since it is possible to construct uniform roll mechanisms for all smooth and fluted rolls, and this results in reducing manufacturing costs.

The two extreme values of the spring characteristic can be varied by the tension or expansion member without a spring as the hardest setting and the expansion member with a long spring assembly and a corresponding arrangement of the individual cup springs as the softest setting. But instead of a cup spring it is also possible to use another kind of spring, for example a spiral or helical wire spring or a pneumatic spring.

Advantageously the means for varying the spring characteristic form a self-contained unit together with a foreign body safety arrangement constructed as a preloaded spring assembly. Advantageously the adjusting device and the variable spring or the entire unit are brought into engagement by means of knife edges at the two bearing housings.

In a preferred constructional form a roll is mounted to be pivotable on a pin in the lower portion of the roll bearing housing. The action of forces at the adjusting devices by way of the corresponding knife edges would take place above in this arrangement. The pressure forces resulting in the grinding gap are held in equilibrium on the one hand above by way of the adjusting device, or the corresponding unit, and below by means of a massive tie member connecting the two bearing housings.

The two bearing housings can be secured pivotably on the tie member by means of pins. In this case the pair of rolls must be held in an upright position with an auxiliary device. The line of force as regards the grinding forces, however, here again can be closed directly by way of the tie member on the one hand and the adjusting device or the unit on the other hand. Only secondary forces, the tension of the drive etc., are taken up with the auxiliary device, and not the actual grinding forces.

It has been found that by securing the bearings of a grinding roll in a non-pivotable manner, assembly is very greatly facilitated. It is possible to fit and dismount each roll individually and also the roll assembly in its entirety.

The fluted rolls, but more particularly the smooth rolls, are disengaged from one another at each interruption in product infeed.

The grinding pressure in the grinding gap amounts in places to several tons. In order to obtain a uniform gap over the entire length of the rolls in spite of the considerable forces, thermal expansion, sagging, flattening etc., the rolls are given a cambered form when produced. If for any reason no material for grinding arrives on the rolls, metal-to-metal contact would occur between the rolls which may result in destruction of the rolls particularly in view of the speed difference between the two rolls. In order to avoid this, suitable sensing and control elements are provided in the material infeed apparatus. Disengagement is permitted with a per se known tension spring in combination with a hydraulic piston. The hydraulic piston engages the rolls again and can be combined with the adjusting device. The tension spring is preloaded with at the most a tension of a few hundred kilograms. Since here again these are only marginal forces which have no influence on the forces in the grinding gap, this tension spring can be secured for example on the roll housing.

As is clear from the foregoing, one of the main ideas is the closed system of forces unit of the roll assembly, the adjusting devices being included in the closed system of forces.

At least in theory it is possible to give the adjusting devices of the grinding gap a hydraulic construction. But since a precise and reproducible setting is required for the grinding, with the solution proposed by the present invention also preferably a mechanical adjusting device is chosen at least for a non-automatic adjusting device.

In a very simple constructional form the foreign body safety arrangement and the adjusting device each act on a knife edge of a bearing housing. In this construction a considerable adjusting force is required which may be in the range of over 1,000 kg. A direct adjustment with a hand wheel is problematic in this case. Motor assistance would be used in actual practice.

In a preferred constructional form the adjusting device comprises an arm pivotably fixed on a bearing housing. The short end of the arm is acted upon by way of the knife edge by the connection which comprises preferably means for varying the spring characteristic and the foreign body safety arrangement, and which provides the operative connection with the second roll. The actual adjusting device acts on the long arm part, which is about 3–4 times greater than the short arm part, but according to the law of levers a force 3–4 times smaller is necessary for adjustment in the range of at the most a few hundred kilograms.

It will be apparent that with the roller mills improved by the present invention, to obtain precise setting values over the entire length of the roll, the adjusting device and the foreign body safety arrangement and the means for varying the spring characteristic are normally provided in twos, one device being arranged at each side of the pair of rolls.

A few particularly advantageous developments of the apparatus for grinding and breaking cereal will be discussed hereinafter.

As explained initially, the desire to have a fully computerised mill has been known for a long time in the art. The practical use of this idea, however, does not appear to be possible at least in the near future because of the complexity of the equipment. It would be desirable to have a very high extraction of white flours, a method cycle which is as short as possible for obtaining flour or semolina, and thus using as little energy as possible for a specific quantity of product. The grinding in itself is to be adapted to the particular nature of the cereal grain structure for this purpose. The external shell portions are to emerge from the grinding in flat fragments and the grain more in cubic pieces.

One of the primary factors for the grinding result in addition to the absolute dimension of the grinding gap is certainly the quantity of product processed per unit of time. For automating the mill it has already been proposed more particularly for the automatic setting of the grinding gap to take the power delivered to the mill as a parameter. But in this way specific properties of the grain, moisture and fluctuations are not taken into account. All such attempts have failed up to the present time.

In recent times many proposals have been made to take as parameters for setting the grinding gap the result of grinding, the behavior and the operation of roller mills. In the introduction the example of the relationships of individual screen fractions was mentioned. It is also possible to take the brightness of the flour as a criterion. Already with these few examples it is possible to show that a single parameter, whether it is a value before grinding or any value after grinding, it is not sufficient for regulating the grinding gap. Sensory monitoring must also be taken into account.

It was also a part of the invention to find a way of automating the grinding which gives a genuine and practical advantage for the grinding of cereal.

To the surprise of experts, it has now been found that the simplest solution is to choose neither the operation nor any instantaneous power fluctuations in the product feed as parameters and instead to take the roll spacing, either as an empirical value or a value ascertained by experiment, and feed it as the desired value to a controller, monitoring the absolute dimension of the roll spacing continuously or at least at intervals of time, measuring and comparing with the desired value by way of a controller, and making a correction to the grinding gap by means of the adjusting device if there is a deviation from the desired value.

Since usually a relatively large number of roller mills are usually used in a flour mill, it may result in a substantial simplification if individual functions of the automatic control operation are respectively stored or issued centrally for all the roll mechanisms.

The basic idea is that instead of the operation of the grinding rolls the pairs of rolls themselves are monitored and an appropriate regulation is made if there is a deviation from a desired value range. The new solution proposed in fact brings unexpected advantages and allows not only an optimum grinding method but also optimum results with the entire mill, so that expense is saved and an improvement in the grinding work is ensured. It is known that flour mills often cannot fully utilise all the possibilities present, whether from the material or the quality points of view, since skilled staff are in short supply. The production manager of the mill cannot be everywhere. Any change whether by the action of an operator or any other, results in effects on the downstream operations, and in some cases even on the preceding operations for example in the event of overloading, thus affecting the grinding work itself. Usually the roll mechanisms must be re-adjusted two or three times after being brought into operation first. This takes up time. During this time the grinding quality if often inadequate. If the same kinds of flour are dealt with over very long periods, with the same cereal mixture, all the operations can be continuously monitored and corrections made. In actual practice it is often found that for example in the case of a flour milling concern which produces mainly a single type of flour and only a few special flours, adjustment for the special flours is carried out defectively or not at all.

The apparatus according to the present invention ensures that a specific desired value setting of the spacing of the two grinding rolls once worked out is immediately adjusted and maintained, so that independently of the duration of a single grinding batch a setting obtained by empirical methods is maintained. The responsible miller can devote himself to his proper task, supervising the entire mill. He has his own human computer freely available so that the proper basis is provided for obtaining the maximum possible results from the entire mill.

In further development of the underlying idea of the invention the control operation is supplemented by an arrangement allowing manual introduction of a corrected desired value for the roll spacing. The corrected desired value is the optimum value for the particular case in question. If there have to be changes at very short intervals of time use will scarcely be made of this possibility. The basic idea is not concerned with varying the actual desired value after each grinding operation. This should be effected only if a similar re-adjustment is necessary after a fairly long period of time. Thus the desired value does not correspond necessarily to the value which was set at the last similar flour production operation, since differences in the weather for example, winter and summer etc., would have an important influence on the two cases.

It is obvious that the most exact values are obtained if the effective dimension of the grinding gap is measured and controlled. But it has been found sufficient to regulate a reference dimension, the effective dimension for example between the bearing housing parts of the two grinding rolls. However, here it is necessary to use also an additional parameter. The best solution for the parameter is found to be the temperature. For example a temperature sensing element can be arranged at one or both bearing housings and is then used as a value for the control operation. The temperature is the main factor which on the one hand is directly connected with the change in size of a body, and on the other hand is a good indication of any modifications in the grinding operation. From the apparatus point of view it must be taken into account that the grinding gap and the grinding rolls and the bearing housing and also the other elements taking part in the flow of forces through the pair of rolls, have different modifications in their dimensions. After each mechanical intervention in the roll assembly, grinding the roll surface, changing bearings etc., the desired value, at least for one type of flour, must be ascertained again by the expert with per se known testing methods and subsequently given in as a new desired value, and the desired values for other flours correspondingly corrected.

With the present apparatus it is possible to optimize the adjustment values over a relatively long time. This ascertained best value can be fed into a store or computer as a desired value. If the same mixture turns up again, the store feeds in the desired value again by way of the automatic control elements. With a short monitoring of the individual grinding results, the correctness of the setting can be monitored and usually left unaltered, corrections being possible at any time as already mentioned although these, after the desired value is fixed, take into account the specific temporarily valid influencing factors.

For each mix a program is set up which controls and regulates all the roll mechanisms, and the special grinding gap setting for the particular grinding stage is associated with each roll mechanism.

Of course it is also possible to arrange that over a relatively long period of time in each case a mix is optimize during the grinding of the entire batch and the best desired value is obtained, subsequently a second mix etc., while the other mixes are dealt with first of all with a roughly set desired value until they are examined in order to obtain the optimum.

It would also be possible to measure the forces acting in the grinding gap, for example by fitting a pressure or force measuring element, for example in the region of the adjusting device or the aforesaid tie member, and to take this into account as a correction value in the controller. But this arrangement makes it necessary to take other factors into account. If for example more product is fed into the pair of rolls temporarily, the grinding gap is to be kept constant and not increased by the product.

The invention will be explained hereinafter with reference to some constructional examples. In the drawings.

Figures 1, 2:
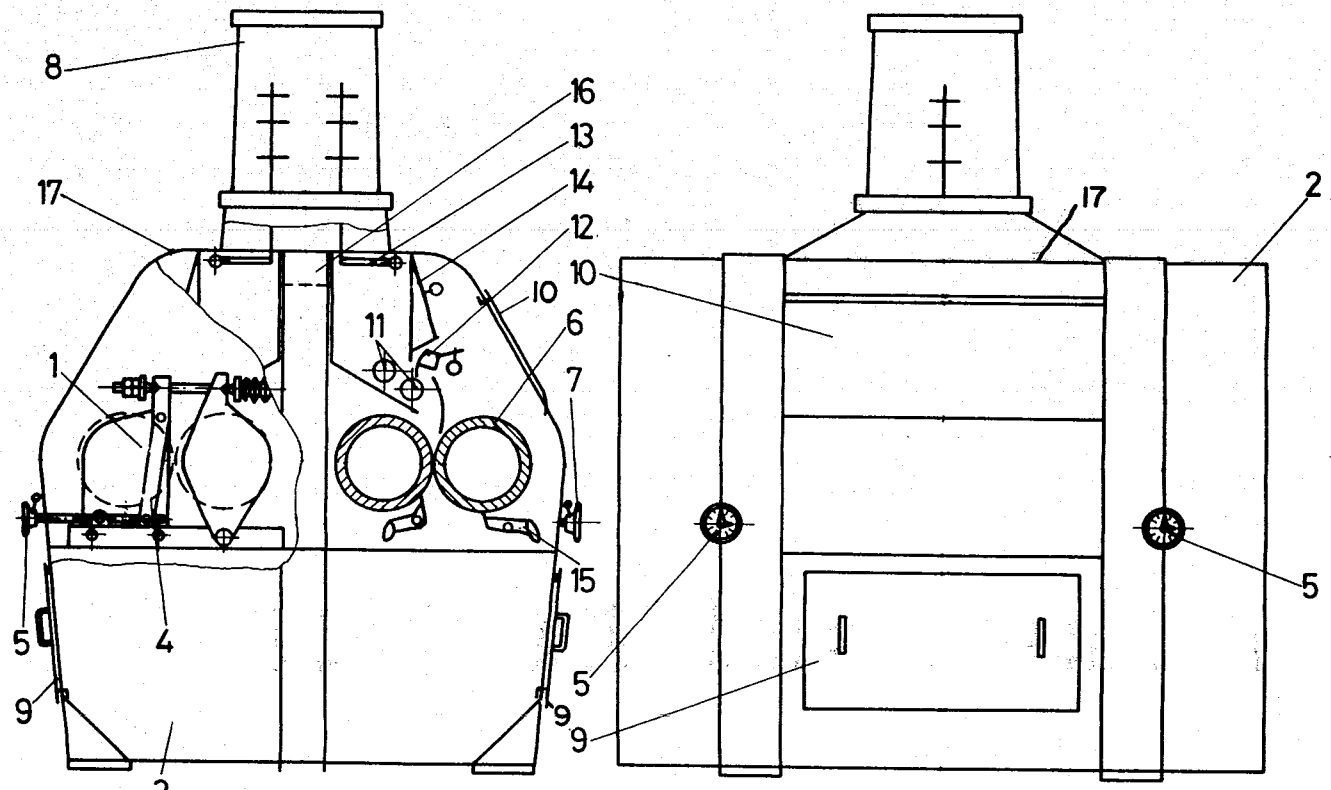
FIG. 1 shows a part elevation and part section through a roller mill.
FIG. 2 shows a control side of the roller mill shown in FIG. 1.

In FIGS. 1 and 2 a roller mill with two pairs of rolls is shown.

In FIG. 1 at the left-hand side the roll assembly 1 is shown in side view, but in this region an external cladding 2 has been partly omitted. The roll assembly 1 is supported on the base 3. An adjusting device 4 comprises a hand wheel 5. The adjusting device 4 and the hand wheel 5 are arranged, as FIG. 2 shows, at the two ends of the roll assembly 1 at the left and right, for independent adjustment of the two roll ends.

The roll mechanism shown in FIG. 1 and FIG. 2 is a so-called 4-roll mill corresponding to the category of a milling industry roller mill. The right-hand half of FIG. 1 shows a section approximately through the middle of the roll mechanism. The roll assembly 6 is usually of the same construction as the roll assembly 1. As FIG. 1 shows, however, all the other devices and auxiliary means are provided at both sides. An adjusting device 7 is also constructed at the roll assembly 6 in accordance with the adjusting device 5. The base 3 forms a common supporting structure for the two roll assemblies 1 and 6, likewise a product feed duct 8 which opens into the middle of the roll mechanism and which consists preferably of glass for easy inspection. At both halves of the roll mechanism there is situated a lower inspection door 9, an upper inspection door 10, respective feed control shafts 11, a feed control gate 12, a product sensing arrangement 13, and an inspection flap 14 and a stripping device 15. The roll mechanism also comprises upper supporting structures 16 secured to the base 3, and a cladding 17 composed of several parts. All the other elements such as the driving motor etc. are omitted in order to leave the drawing easier to read. Reference should be made to known constructions. In very rough outlines the operation of the roll mechanism can be described as follows:

The feed control shafts 11, control gate 12, and product sensing arrangement 13 are brought into action. Product is fed into the roll mechanism through the product feed duct 8. The product sensing arrangement 13 detects the arriving product and engages the rolls.

With the hand wheel 5 the grinding gap is approximately adjusted by means of the adjusting device 4 or 7 respectively. When a particular product is being ground for the first time, the inspection door 9 is opened and a sample of the product is taken to check the grinding work at two or three places along the length of the grinding rolls, and suitable readjustments are made at more or less long intervals of time, either as regards product feed, temperature control, for example, by means of water cooling, and particularly the roll spacing.

Figure 3:
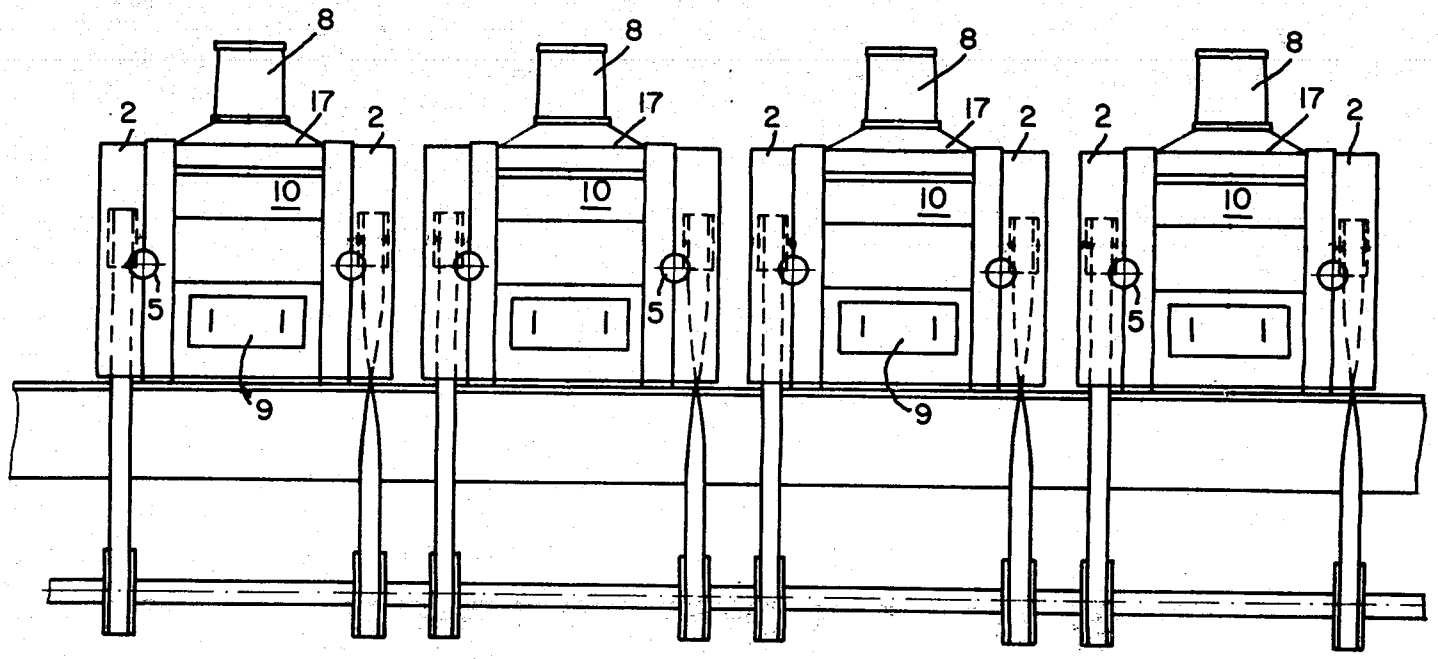
FIG. 3 shows a view in diagrammatic manner of a group of roller mills.

FIG. 3 shows a typical arrangement of a plurality of roll mechanisms, and in very many cases, as illustrated, each pair of rolls is driven by means of a common shaft and transmission belt. Usually almost all the roller mills are in operation during grinding.

A roll assembly which is more particularly the subject of improvements, is shown in a diagrammatic manner in FIG. 4, to which reference will now be made.

The pair of rolls comprises the left-hand roll 20 and the right-hand roll 21. The left-hand roll 20 is mounted on stub shafts 22 in a bearing housing 23 which itself is supported on a pivot pin 24 arranged below.

The right-hand roll 21 is connected by way of the stub-shafts 25 in a non-mobile bearing housing 26, and the bearing housing 26 with a tie member 27. Both the tie member 27 and the bearing housings 23 and 26 respectively are arranged in oppositely identical manner at the two ends of the roll assembly and held by longitudinal connections 28. The roll assembly is supported on a base 29 shown as a simple beam, and held in position by bolts 30.

An adjusting device 31 is shown for manual operation. The action of the adjusting device is effected by way of a tension member 32 which acts on the bearing housing 23 and 26 respectively at the two ends with bearing elements 34 and 35 constructed as knife edges 33. The spacing between the two grinding rolls 20 and 21 could be set by rotating the nut 36 and re-adjusting the lock nut 37. In this case the knife edge 33 would have to act directly on the bearing housing. In FIG. 4, however, a more advantageous solution for hand operation is shown. The knife edge 33 acts on an arm 38. The arm 38 is secured by means of a pivot pin 39 on the bearing housing 26. The arm 38 comprises at the top a short free end 38′ and below a long free end 38″, the knife edge 33 acting on the relatively short free end 38 and a hand wheel 40 acting on the longer free end 38″. The hand wheel 40 is held to be rotatable in a pivot pin which is on a fixed axis. The hand wheel 40 is extended by a screwthreaded portion 42 screwed into a ball sleeve provided with an internal screwthread. The ball sleeve 43 is prevented from rotating with the screw thread portion 42 and is situated in a larger number of cup springs 83 is used than that a bore 44 in the relatively long free end 38″ of the arm 38. The hand wheel 40 with the screwthreaded portion 42 is secured with a shoulder 45 and with a securing ring 46 abutting on the pivot pin 41 against longitudinal movement in the axial direction of the hand wheel 40.

The roll assembly operates as follows:

A first rough adjustment of the distance between the two rolls 20 and 21 is made with the nut 36 and lock nut 37. For example the grinding gap can be adjusted to 0.5 mm. Fine adjustment by means of the hand wheel 40 is require for grinding. The distance between the two knife edges 33 is then kept constant. By turning the hand wheel 40 in the clockwise direction, with a right-hand thread, the arm 38 turns in the counter-clockwise direction, and the short free end 38′ moves towards the left. The roll 20 is mounted as far as the pivot pin 24 is concerned with its center of gravity such that it has a tendency to move towards the left away from the roll 21. With a feature of this kind, with a relatively large grinding gap it is possible to prevent the grinding rolls from contacting one another. The product itself effects the grinding pressure in the grinding gap, forces being produced for moving the two rolls 20 and 21 away from one another. These forces must be counteracted with the adjusting devices 31 and the tie members 27 of the pair of rolls. The object of the roller mill is to maintain constant the optimum grinding gap once it has been determined, and not primarily the grinding pressure. As FIG. 4 shows, the grinding gap is influenced directly by means of the adjusting device 31 so that disturbing influences from the roll stand and housing parts can be kept away from the grinding operation.

Figure 4:
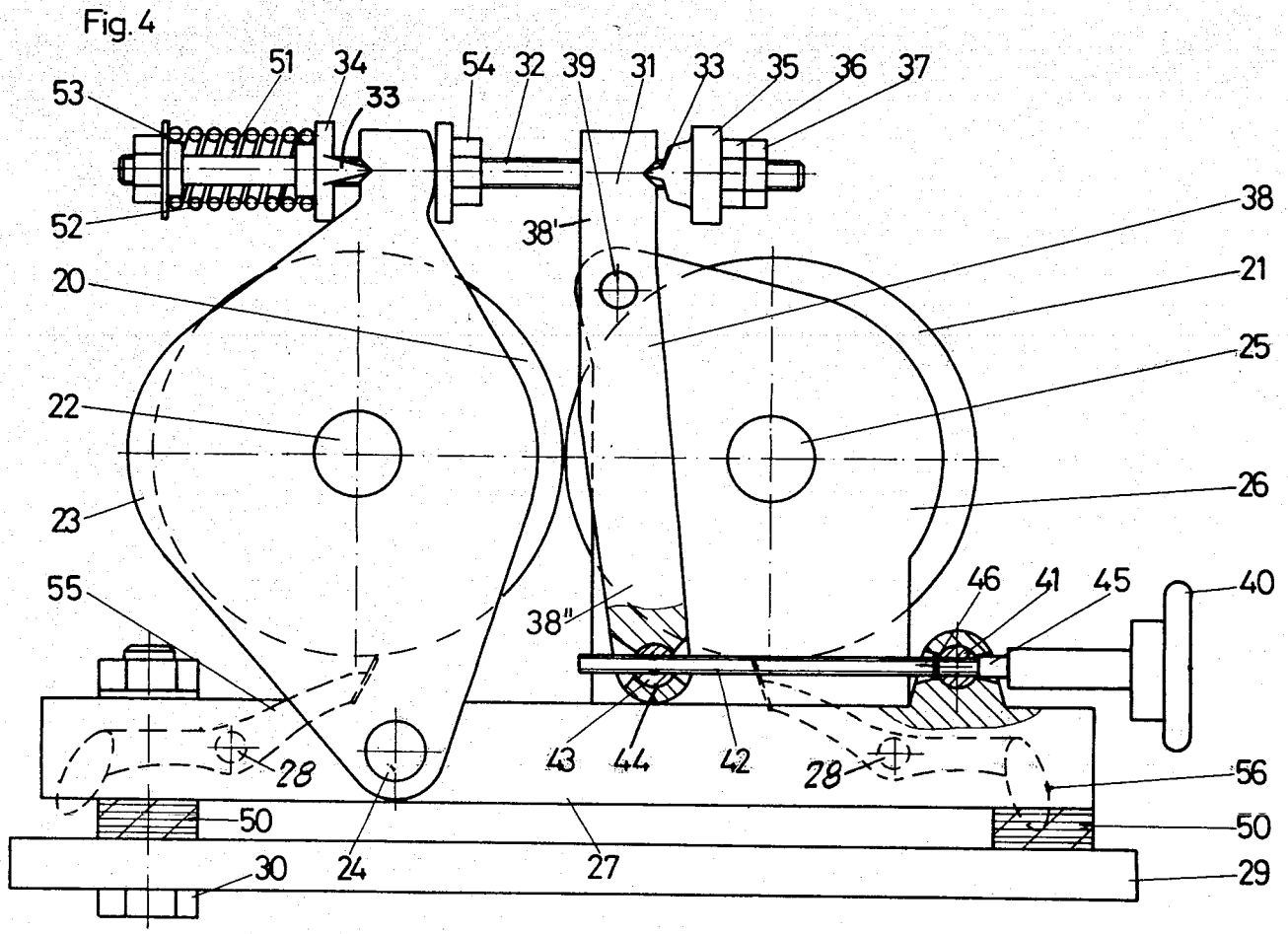
FIG. 4 shows a view in partial diagrammatic form of a roll assembly.

FIG. 4 also shows particularly interesting further features.

The roll assembly is supported not directly but by way of a damping intermediate layer 50. This particular measure was not possible in the known constructions of roller mills used in milling, since otherwise the grinding gap could not be controlled. Damping materials have the unpleasant property that they become deformed after some time so that it would be impossible to maintain specific dimensions by the use of damping elements except by complicated roundabout measures. Depending on special requirements expected of the roll mechanism for example with regard to noise problems, the damping material may be rubber. Deformation of a rubber intermediate layer must be compensated by appropriate construction of the drive, for example by providing a self-tensioning drive and the like.

A further feature of the invention is the formation of a structural group formed by the tension member 32 and further parts of the adjusting device, and also a foreign body safety arrangement 51. The foreign body safety arrangement 51 comprises a spring 52 which is preloaded between an end disc 53 and the bearing element 34 by a clamping nut 54. The spring is preloaded to a value 1–2 and more times the grinding pressure to be expected, so that the spring 52 is compressed only when a foreign body enters beyond the amount of the preload, and correspondingly the spacing between the two grinding rollers increases.

A further interesting feature of the invention consists in that each roll 23 and 21 respectively has associated with it a stripping blade 55 and 56 respectively, these being supported for example with the longitudinal connections 28. The stripping blades in this way always retain the same situation relatively to the corresponding rolls, so that any change in position of the entire roll assembly owing to yielding of the damping intermediate layer 50 does not have any influence.

Figure 5:
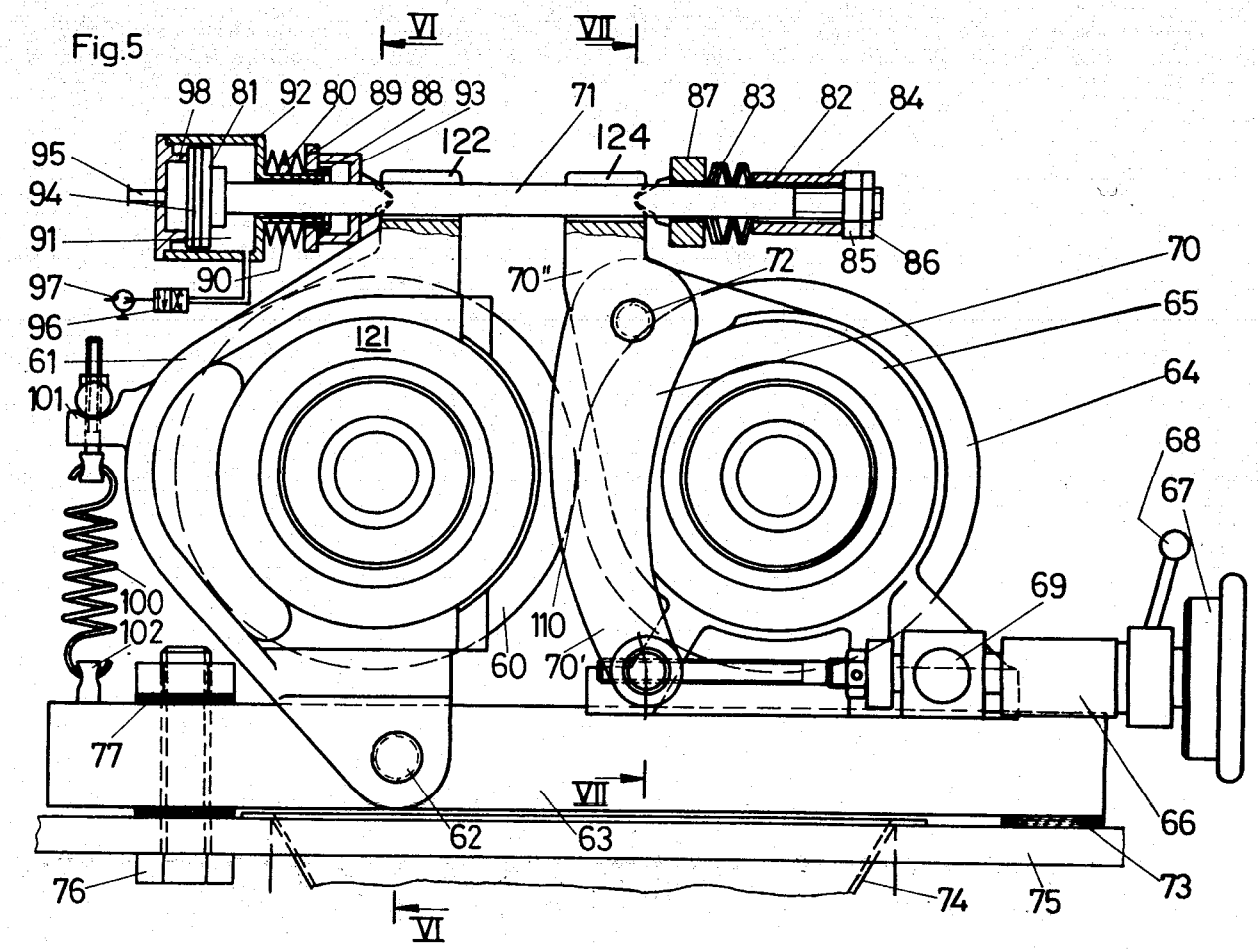
FIG. 5 shows a constructional example corresponding to FIG. 4.

FIG. 5 shows a further constructional example of a roll assembly, the basic construction regarding the roll bearing supporting arrangement and adjusting device corresponding to the constructional example shown in FIG. 4. The left-hand roll 60 in FIG. 5 is held with a bearing housing 61 by means of a pivot pin 62 on a tie member 63. The right-hand roll 64 is connected by way of a bearing housing 65 to the tie member 63 so that here again a part of the grinding pressure passes through the tie member 63. The adjusting device 66 comprises a hand wheel 67, an arresting device 68, a pivot pin 69 which is not capable of displacement relatively to the bearing housing 65, and a ball joint built into a relatively long free end 70' of an arm 70. The arm 70 also comprises a relatively short free end 70'' which connects the two rolls 60 and 64 by way of a knife edge with a tension member 71 and a pivot pin 72 which holds the arm 70 to be capable of pivoting relatively to the bearing housing 65.

A damping intermediate layer is constructed as a thin plate 73 in FIG. 5. This has the advantage that on the one hand vibration and noise problems can be reduced, and owing to slight elastic yielding of the thin plate 73 no special requirements have to be met as regards the drive and transmission.

As illustrated diagrammatically in FIG. 5, a product collecting hopper 74 formed of sheet metal parts is secured directly on a base 75. The vibrations are therefore less easily transmitted to the sheet metal parts. It is possible by deliberate choice of material and the thickness of the plate 73 to reduce to a minimum specific frequencies which are transmitted particularly strongly by the sheet metal parts.

Preferably damping intermediate shims 77 are arranged at the fixing bolts 76 also for preventing transmission of vibrations of the roll assembly to the base 75 and the other parts of the roll mechanism.

In the constructional example shown in FIG. 5 the tension member 71 forms a unified group together with a foreign body safety arrangement 80, a roll engaging device 81, and also means 82 for varying the spring characteristic. The means 82 for varying the spring characteristic are formed of a cup spring 83, a spacer tube 84, an adjusting screw 85, a lock nut 86, and a bearing element 87.

The foreign body safety arrangement 80 consists of a cup spring assembly 90 preloaded with a clamping screw 88 by way of a disc 89, the said assembly being arranged at the housing 91 of a hydraulic cylinder 92 of the engaging device 81. Situated at the housing 91 is a sleeve which extends through the cup spring assembly and is provided with an external screwthread and which takes up the preloading forces. The foreign body safety arrangement 80 bears on the bearing housing 61 by way of a bearing element 93 constructed with a knife edge. The tension member 71 is at the same time a piston rod and carries the piston 94 of the roll engaging device 81. The hydraulic cylinder comprises a venting aperture 95 and also at the opposite side a connection to the valve 96 and to a pressure source 97. At the side of the venting aperture an abutment 98 is arranged in the internal space of the hydraulic cylinder 92.

A disengaging device for the grinding rolls is also arranged at the bearing housing. A tension spring 100 is tensioned between a projection 101 of the bearing housing 61 and an eyelet 102 of the tie member 63.

Because of what has been said hitherto it follows that the means 82 for modifying the spring characteristic and the means for providing safety against foreign bodies and the roll engaging device 81 are provided twice over, in each case at the two ends of each roll assembly.

The roll assembly shown in FIG. 5 operates as follows:

The foreign bodies safety arrangement 80 is usually fitted in the preloaded state, for example the cup springs being compressed between disc 89 and housing 91 of the hydraulic cylinder 92 with the clamping screw to a specific amount in accordance with approximately one to two tons preloading force.

In the condition of rest, the tension spring 100 and also a moment acting in the same direction from bearing housing 61 or the roll 60 respectively with a force of several hundred kg effects a movement of the rolls 60 and 64 away from one another. The bearing housing 61 is pressed towards the left by way of knife edges of the bearing element 93 on to the foreign body safety arrangement 80 against the housing 91 of the hydraulic cylinder 92. The rolls can rotate in the disengaged state. By closing the valve 96 and bringing into action the pressure source 97 the entire unit of housing 91, safety arrangement 80 with roll 60 and the bearing housing 91 is moved towards the roll 64 into the illustrated position. During normal operation the oil pressure from the pressure source 97 presses the piston 94 strongly against the abutment 98.

The oil pressure is selected to be so great that the forces of the hydraulic medium are greater than the forces in the grinding gap, so that the hydraulic part and also the foreign body safety arrangement 80 do not yield at least in the range of normal grinding forces, and behave like a rigid block.

For the grinding of very fine product, the grinding gap 110 is adjusted with corresponding fineness. In this case the means 82 can be used for modifying the spring characteristic. Although it is known that cup springs represent hard springs or in other words have a very steep spring characteristic, the cup spring in the operative inter-connection unit of the roll assembly must be regarded in relation to the only very slightly elastic rolls, bearing housings and tie members. The cup springs 83 are slightly preloaded by the tension spring 100. This has the advantage that the play which in actual practice must always be provided between parts which have to move is taken up. The spring 100, however, has only an inconsiderable influence on the forces in the grinding gap since these are greater by a factor of about 10. The tension spring 100 is also not in the closed system of forces unit.

FIG. 5 shows the engaged position of the two rolls 60 and 64. The piston 94 is on the abutment 98. In this position, product is ground. At the first grinding of a new mixture the grinding gap is roughly set by the adjusting device and at once the result of the grinding work is checked by examination of several samples of grinding product taken through the inspection door 9 (FIG. 1) below the grinding rolls, and the spacing of the rolls 60 and 64, or grinding gap, is corrected. During grinding of a batch of product re-adjustments are also carried out with the hand wheel 67.

Under ideal grinding conditions per se it would be desirable to aim at maintaining rigidly a grinding gap once it has been determined. But in practice there are always disturbing influences, unilateral loading of the rolls, deviations in external shape, for example departures from concentrically or non-uniform roll temperatures etc. More particularly with very fine grinding using a grinding gap of about 1/10 of a millimeter or less, most problems occur. With very fine grinding a larger number of cup springs 83 is used than that shown in FIG. 5 and thus the rolls 60 and 64 can be given a very soft behaviour in co-operation with one another.

But if a grinding gap of more than 2/10 millimeter or even larger is set, the cup springs 83 can be completely removed and a relatively rigid roll assembly is obtained, which in this case gives the best possible conditions for a uniform grinding result.

By varying the number of cup springs, any desired intermediate value can be adjusted for the softness of the roll assembly. The tension member 71 can also be constructed as an expansion member and thus by interchanging same the means for varying the spring characteristic can also be arranged at another region of the roll assembly, for example by using various elastic arms 70. It is also possible to support one or both rolls 60 and 64 or the bearing housings elastically.

If the adjusting device with hand wheel 67 is provided only for hand adjustment of the grinding gap, the means for varying the spring characteristic are to be formed preferably of true spring elements, since rubber-like parts become permanently deformed in the course of a relatively long period of time and therefore precise setting values are not possible.

Figure 7:
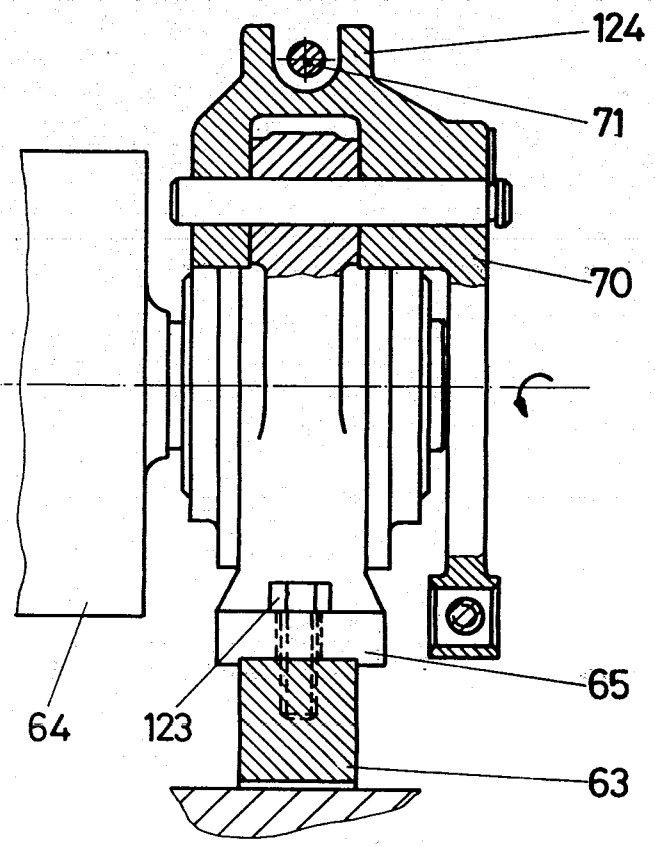
FIG. 7 shows a section along the line VII—VII of FIG. 5.
Figure 6:
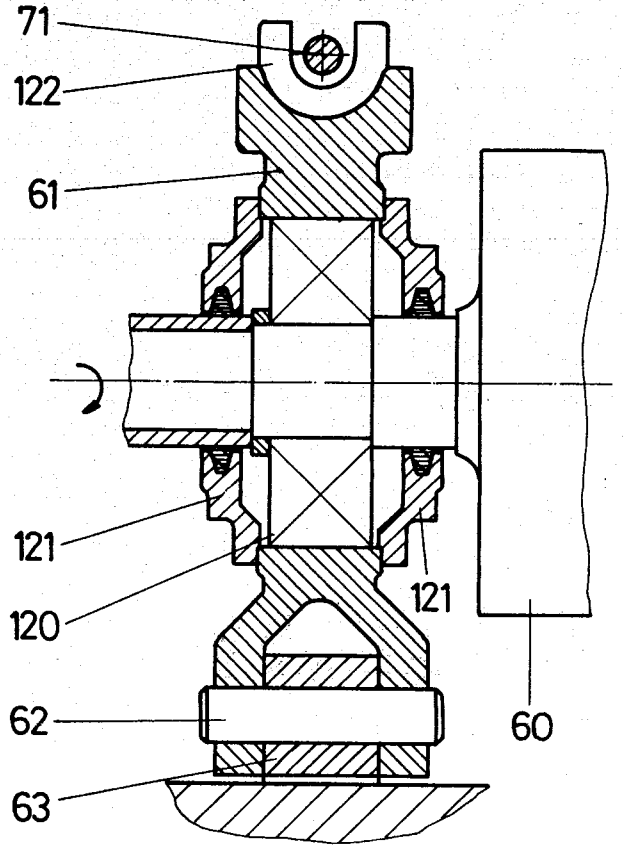
FIG. 6 shows a section along the line VI—VI of FIG. 5.

FIG. 6 shows a section on VI—VI of FIG. 5 in the bearing housing 61 and FIG. 7 a section on VII—VII of FIG. 5. The roll 60 is held by means of a ball bearing roller bearing or sliding bearing 120 in the bearing housing 61. The bearing housing is closed at both ends by bearing covers 121. The bearing housing 61 comprises in the upper portion a claw 122 for the engagement of the adjusting device. Below, the bearing housing 61 is secured on the tie member 63 to be pivotable by means of the pin 62. The arm 70 comprises at the upper region a claw 124 which is connected by way of the tension member 71 with the adjusting device.

Figure 8:
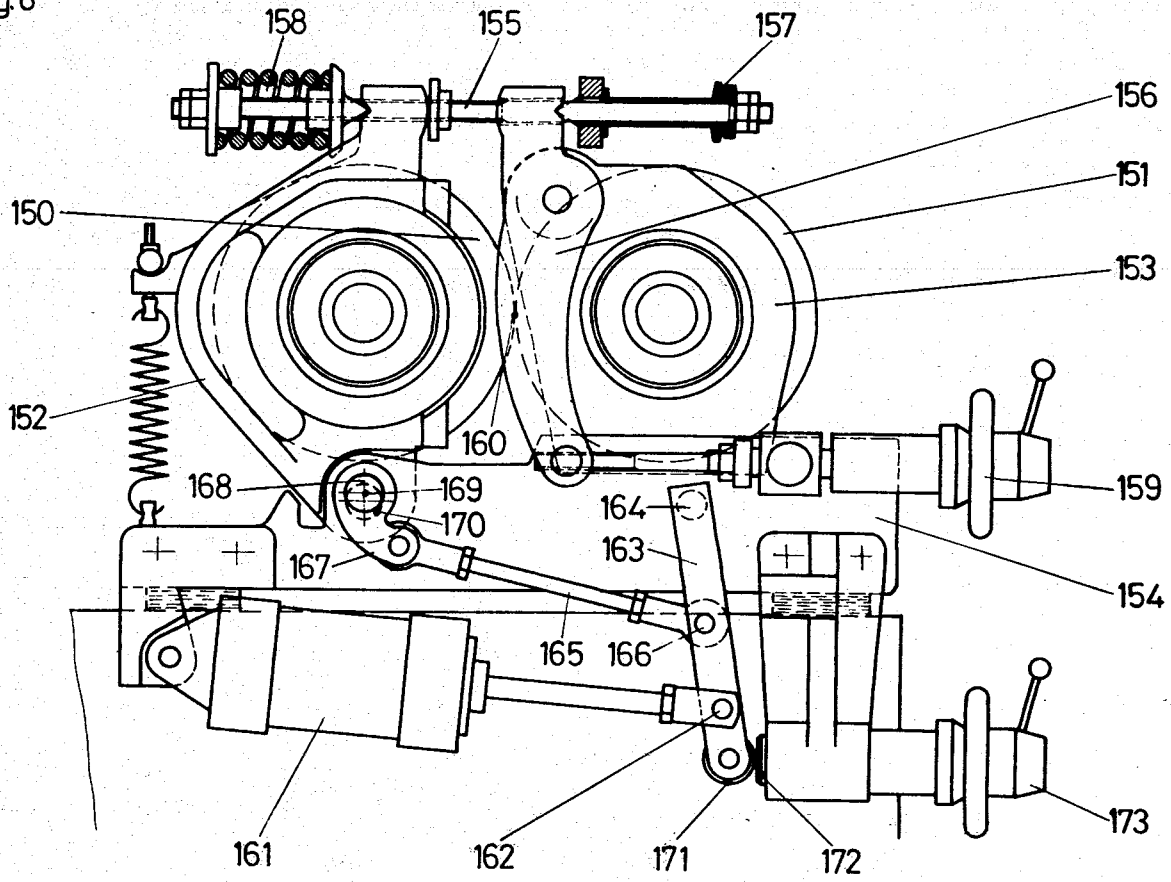
FIG. 8 shows a further constructional example of a roll assembly.

FIG. 8 shows a further constructional example.

The rolls 150 151 are operatively connected by means of bearing housings 152 and 153 respectively through the agency of a massive tie member 154 on the one hand and by way of a tension rod or member 155 of an adjusting device 156 on the other hand. The means for varying the spring characteristic are shown by only two cup springs 157. A foreign body safety arrangement 158 is connected with the tension member 155. The adjusting device 156 also comprises a hand wheel 159 which is arranged at each side of the roll assembly on the roll ends. The grinding gap 160 can be adjusted independently with the adjusting device 156 arranged at both sides, with a hand wheel 159 arranged at each of the two sides.

FIG. 8 shows in a diagrammatic manner a parallel adjusting arrangement and also a pneumatic engaging and disengaging device. A pneumatic cylinder 161 by way of a pin 162, moves a lever 163 to and fro about a fixed pivot point 164. Also secured on the level 163 at a pivot pin 166 is a rod 165 so that the rod moves to and fro with the lever. The rod 165 is connected pivotably to a strap 167 which is arranged rigidly on an eccentric shaft 168. The eccentric shaft rotates about the pivot point 169. The bearing housing 152 is mounted on the actual eccentric 170 so that when there is to and fro movement of the rod 165 the roll 150 can be engaged and disengaged horizontally with a very considerable transmission ratio. The eccentric shaft 168 is taken right through over the entire length of the roll from one bearing housing 152 to the opposite housing. In the second bearing housing also there is the same eccentric construction, so that both bearing housings carry out the same movement.

FIG. 8 shows the engaged position of the roll. The lever 163 comprises at its lower end a roller 171 which abuts against an abutment 172. Because of the foregoing, it follows that there is a simultaneous or parallel adjustment of the grinding roll 150 when the abutment 172 is modified. For this purpose the abutment 172 is adjusted by a hand wheel 173. The hand wheel 173 allows the so-called parallel adjustment.

Figure 9:
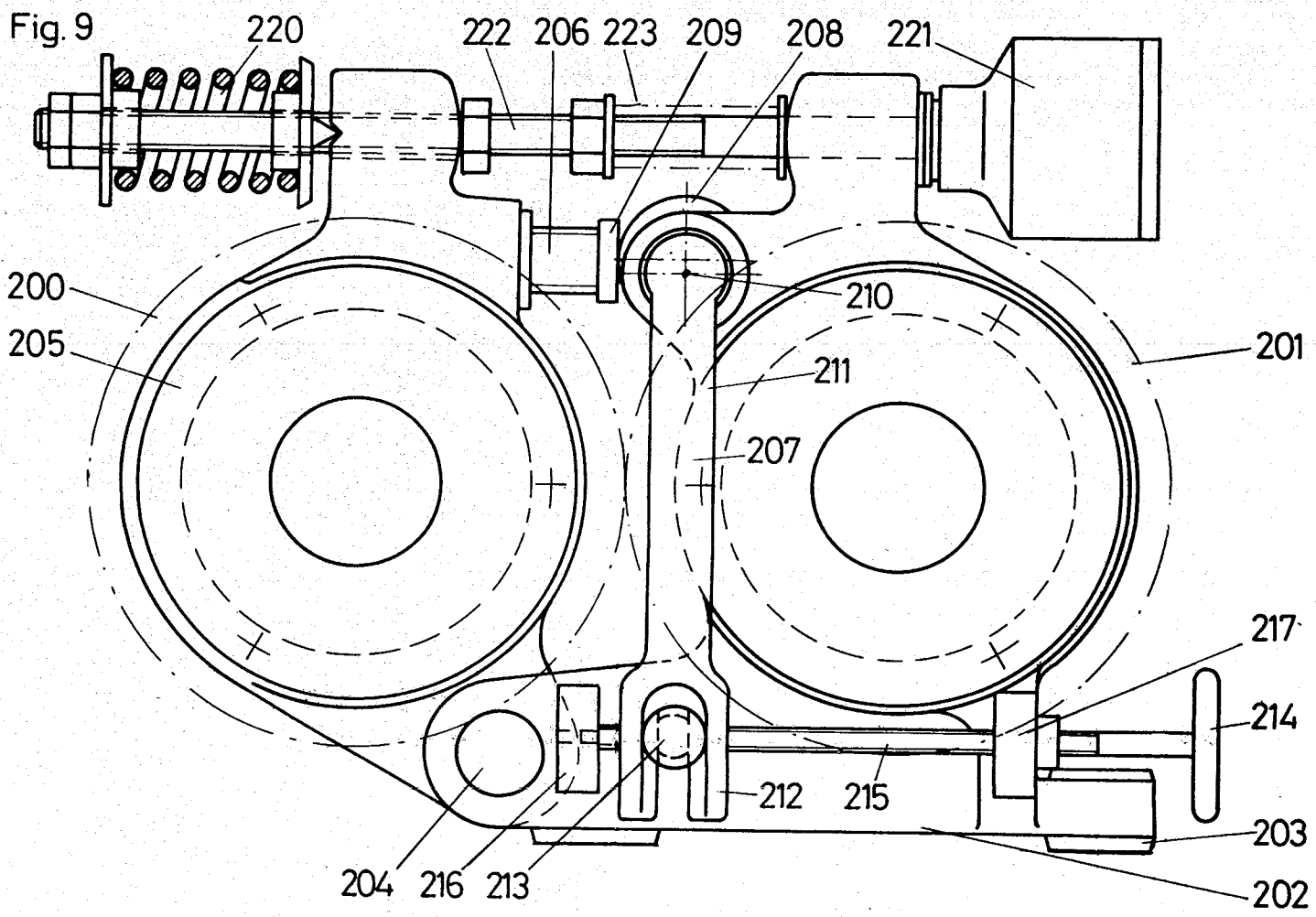
FIG. 9 shows a further constructional example of a roll assembly.

FIG. 9 shows a further example of a roll assembly. The pair of rolls comprises a left-hand grinding roll 200 and a right-hand grinding roll 201. The right-hand grinding roll 201 is supported with two fixed bearings or bearing housings 202 by means of feet 203 on a base. The left-hand grinding roll 200 is connected with a pivot pin 204 by way of a bearing housing 205 with the bearing housing 202.

In the constructional example shown in FIG. 9 the lower value of the grinding gap is limited by a fixed abutment 206. Adjusting means 207 act by way of an eccentric 208 directly on an abutment surface 209 of the abutment 206. The eccentric 208 is pivotable about a pivot point 210 of an adjusting arm 211. The eccentric 208 is connected securely to the adjusting arm 211 and is held by the bearing housing or housings 202. The adjusting arm comprises, below, a fork-like end piece 212 in which a cam 213 engages in such a manner to be capable of displacement. The cam 213 is adjusted by a hand wheel 214 by way of a screwthreaded rod 215. The rod 215 is mounted at the left in a lug 216 and at the right in a lug 217, and at the same time held by means not shown here in the longitudinal direction of the screwthreaded rod 215. The lug 216 and the lug 217 are parts of the bearing housing 202.

Then if the hand wheel 214 is rotated and the adjusting arm 211 is adjusted for example in the counterclock-wise direction, the cam 213 is displaced in the forklike end 212 of the adjusting arm 211 and at the same time the rotary movement of the eccentric 208 moves the abutment 206 towards the left and thus the two grinding rolls are moved apart from one another. In this way a grinding gap can be adjusted from 0 to a maximum, the lower value being held by the abutment. In this way it is possible to adjust a very precise setting of the grinding gap and thus very good consistency is obtained in the grain size of the product. It has now been found that this constructional form can be advantageously supplemented for the production of very fine flours by cooling the rolls. In a further constructional form the roll can be partly filled with a liquid so that the liquid provides a temperature equalisation. In this way resonance build-ups are eliminated. More particularly with partial filling of the grinding rolls with a liquid such as for example water or alcohol, the heat produced locally in the grinding gap is distributed very quickly over the entire roll. This is all the more important as there is in fact a really rigid guiding arrangement for the rolls. Since the rolls cannot go below the lower value of the grinding gap given by the abutment 206, the means for varying the spring characteristic are less effective here and therefore not necessary. On the other hand, the roll assembly in practice must almost always be provided with a foreign body safety arrangement 220 and a roll engaging device 211, which can be constructed as a hydraulic cylinder as in FIG. 5.

The foreign body safety arrangement 220 and the roll engaging device 221 are made to form a single unit with a tension member 222 in the example shown in FIG. 9 also, connecting the two grinding rolls. Both in the foreign body safety arrangement 220 and in the roll engaging device, forces are used which are greater than the forces in the grinding gap, so that opening of the grinding gap is possible only with exceptional forces which may be produced with large foreign bodies, for example pieces of wood or iron. Disregarding thermal expansion and other deformation of the roll bodies and the bearing parts, in this constructional arrangement the grinding gap remains absolutely constant during normal grinding. The two rolls 200 and 201 are pressed apart from one another by a compression spring 223 so that the grinding rolls take up a specific position when the roll mechanism is brought into action.

Figure 10:
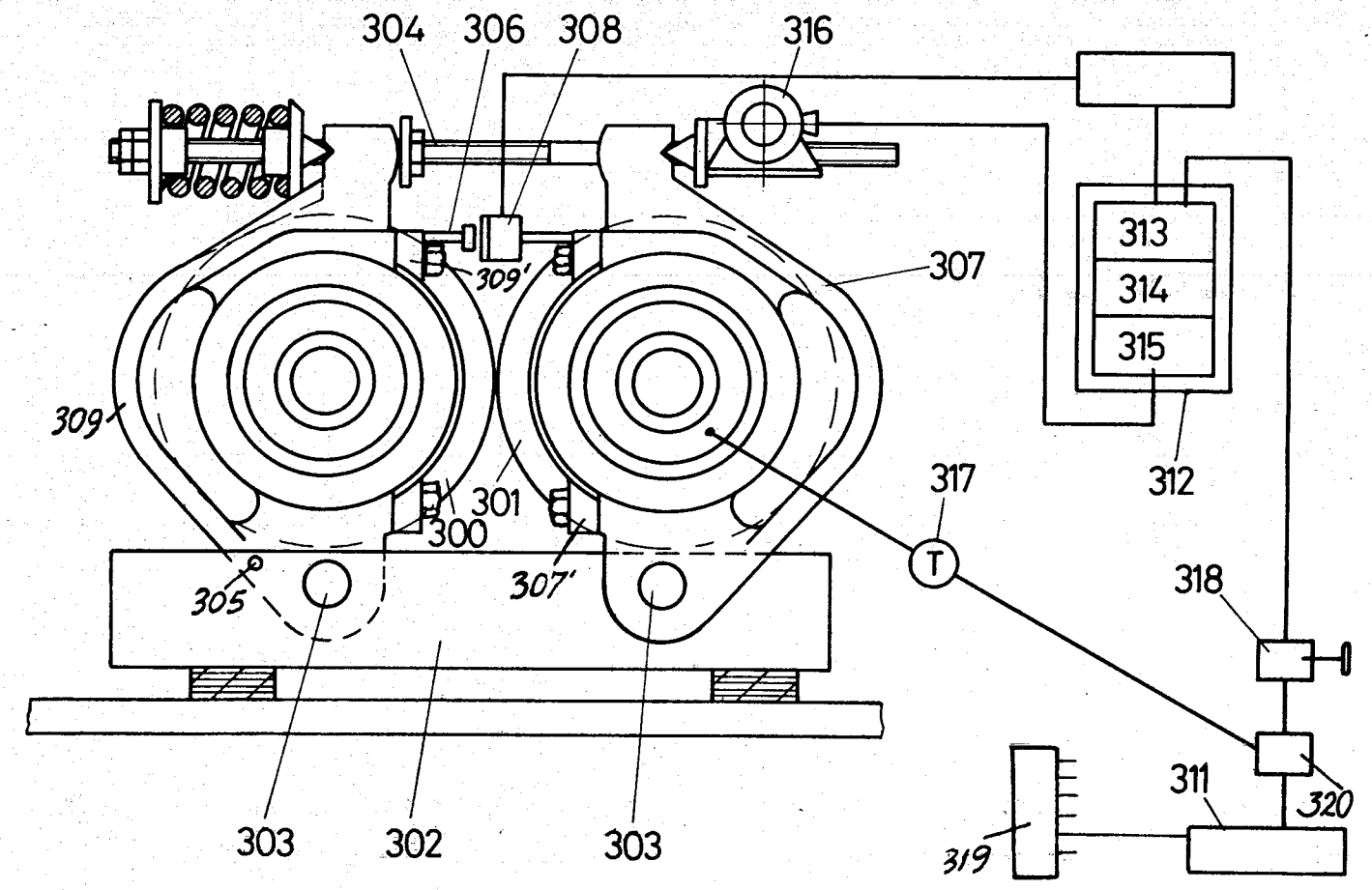
FIG. 10 shows diagrammatically an example of an automatically controlled adjusting device.

A very brief description will now be given of the parts of the grinding gap regulating arrangement shown in FIG. 10. The roll assembly comprises a left-hand grinding roll 300 and a right-hand grinding roll 301, which are held on the one hand, below by means of a tie member 302, and through the agency of pivot pins 303, and on the other hand above by the adjusting means 304. In order to ensure the upright position of the roll assembly, the bearing housing of the grinding roll 300 is held by a pin 305.

In the illustrated constructional form it is not the absolute size of the grinding gap which is determined but a reference dimension, the spacing in the upper part of the bearing housing. The left-hand bearing housing 309 comprises a fixed contact maker 306, and the right-hand bearing housing 307 a proximity switch 308. The latter may be of any known make, and it is simply necessary that it should determine the absolute dimension very precisely and preferably in the form of an electrical value which it can give as a so-called actual value to a control unit.

The desired grinding gap value is preset in a store 319 in any desired form, for example on punched cards. The card reader can be controlled by a computer not shown here. In accordance with the desired grinding gap a desired value 311 is given to the controller 312. The controller comprises a comparator 313, an amplifier 314 and a converter 315. The output signal from the controller 312 is fed directly into an adjusting motor 316 which continuously or at intervals adjusts the grinding gap by motor means.

In order to allow dimension deviations owing to temperature influences to be corrected, there is provided at at least one roll unilaterally or at both sides a temperature sensing element 317 with which a temperature controller 320 is associated. In this way the desired value is corrected by a temperature factor. This operation also can be carried out at intervals. In order to make it possible to take into account specific values such as deviations in product properties etc. in the case of any mixture or grinding operation, there is also provided a hand input 318 with which the desired value can also be corrected. The temperature influence is automatically corrected whereas all other factors influencing the grinding result are monitored and measured in the hitherto known method and can be fed in by hand. The great advantage however is that the desired value in every case can be specifically corrected and the corrected values are held by the controller.

The controller keeps the grinding gap constant, and temperature deviations and corresponding expansion phenomena are continuously taken into account also and more particularly the grinding gap is also regulated in accordance with the values fed in by hand, as a corrected desired value.

The pair of rolls constructed as a roll assembly according to the invention allows the manufacturer and also the client to mount and dismount the entire assembly as a single unit in the case of relatively large changes. But the customer is also given a particular advantage if the two bearings of the two rolls are divided and therefore the rolls can also be dismounted individually. For this purpose the bearing housing 309 comprises a dismountable bearing half 309' and the bearing housing 307 a dismountable bearing half 307'. This affords the great advantage that for example with minor inspections the rolls can be taken out individually and with major inspections the entire assembly can be taken out. In this way servicing can be carried out more advantageously.

What is claimed is:

1. A roller mill for the milling of cereal or the like comprising:

a main base frame arranged to be mounted on the floor of a mill house;

first and second mill rolls;

a pair of fixed bearing housings supported on said main base frame to carry said first mill roll;

a pair of movable bearing housings supported on said main base frame to carry said second mill roll and adjustable loading means operative between said fixed bearing housings and said movable bearing housings to contain the separating forces acting on said mill rolls in operation of the mill; independently from said main frame;

said adjustable loading means having a tie member;

first roll gap adjusting means arranged between said fixed and movable bearing housings and second roll gap adjusting means operatively interposed between said first roll gap adjusting means and said tie member;

said fixed and movable bearing housings being respectively mounted on said tie member independently of said main base frame and said tie member being supported on said main base frame, said first roll gap adjusting means including a loading member arranged between said fixed and movable bearing housings and said second roll gap adjusting means including a lever means pivotally mounted on one of said bearing housings and associated with said first roll gap adjusting means so that the pivoting of said lever means adjusts the roll gap and a screw adjustment device operatively arranged between said lever means and said tie member.

2. A roller mill as claimed in claim 1, in which said first roll gap adjusting device includes an overload device arranged to limit the load applied to the rolls in operation of the mill.

3. A roller mill as claimed in claim 1, in which vibration damping means is interposed between said tie member and said main frame.

4. A roller mill as claimed in claim 3, in which said damping means comprises a resilient shim or spacer.

5. A roller mill as claimed in claim 4, in which said damping means comprises a solid shim or spacer.

6. A roller mill as claimed in claim 3, in which said overload device comprises a preloaded spring means.

7. A roller mill as claimed in claim 1, wherein there is provided one of said adjustable loading means at each end of said first and second mill rolls, each of said loading means being arranged to operate independently of each other.

8. A roller mill as claimed in claim 1, in which said movable bearing housings are pivotally mounted on said tie member.

9. A roller mill as claimed in claim 8, in which said loading member engages one roll bearing housing by way of a fluid pressure operated piston and cylinder device which is operable to open or close said roll gap.

10. A roller mill as claimed in claim 8, in which the pivots for the movable bearing housings include a rotatable eccentric by means of which said second roll may be moved relative to said first roll.

11. A roller mill as claimed in claim 10, including fluid pressure operated means for rotating said eccentric.

12. A roller mill as claimed in claim 10, including an adjustable stop device for limiting the rotation of said eccentric.

13. A roller mill as claimed in claim 1, in which said loading member engages the respective roll bearing housings by way of knife edges.

14. A roller mill as claimed in claim 1, in which said loading member engages one roll bearing housing by way of means adapted to adjust the spring characteristic between said rolls.

15. A roller mill as claimed in claim 14, in which said means to adjust the spring characteristic comprises a resilient device.

16. A roller mill as claimed in claim 1, in which said loading member is chosen to have a resilience to give a desired spring characteristic between said rolls.

17. A roller mill as claimed in claim 1, in which said lever means includes a double armed lever and said loading member engages the bearing housing of said one roll by way of one arm of said double armed lever.

18. A roller mill as claimed in claim 17, in which said screw adjustment device is operative between the other arm of said double armed lever and said tie member.

19. A roller mill as claimed in claim 18, in which said one arm of said lever is shorter than said other arm.

20. A roller mill as claimed in claim 1, in which said first roll gap adjusting means includes an adjustable abutment interposed between said bearing housings for said roll pair to control said roll gap.

21. A roller mill as claimed in claim 20, in which said first roll gap adjusting means includes an eccentric rotatably mounted in the bearing housing of one of said rolls connected to said lever means and arranged to engage said abutment.

22. A roller mill for the milling of cereal or the like comprising:

a main base frame arranged to be mounted on the floor of a mill house;

first and second mill rolls;

a pair of fixed bearing housings supported on said main base frame to carry said first mill roll;

a pair of movable bearing housings supported on said main base frame to carry said second mill roll and adjustable loading means operative between said fixed bearing housings and said movable bearing housings to contain the separating forces acting on said mill rolls in operation of said mill, independently from said main frame, said adjustable loading means having a tie member;

first roll gap adjusting means arranged between said fixed and movable bearing housings and second roll gap adjusting means operatively interposed between said first roll gap adjusting means and one of said bearing housings;

said fixed and movable bearing housings being respectively mounted on said tie member independently of said main base frame and said tie member being supported on said main base frame;

said first roll gap adjusting means including a loading member arranged between said fixed and movable bearing housings and said second roll gap adjusting means including a screw adjustment device operatively arranged between said loading member and one of said fixed or movable bearing housings;

servo motor driven means connected to said screw adjustment device for adjusting the roll gap between said rolls;

a transducer arranged to give a first signal directly related to said roll gap;

preset means for establishing a second signal related to a desired value of said roll gap; and a controlled arranged to compare said first and second signals and to drive said servo motor driven means to maintain said roll gap at a desired value in response to said comparison.

23. A roller mill as claimed in claim 22, wherein there is provided one of said adjustable loading means between the bearing housings at each end of the mill rolls to control the roll gap at the respective end independently of the other.

24. A roller mill as claimed in claim 22, in which means is provided for storing a number of preset values of said second signal, whereby the roll gap may be set up accordance with a selected one of that number of values.

25. A roller mill as claimed in claim 22, in which means is provided for varying said second signal in accordance with an operating variable of the machine such as roll temperature or roll pressure.

* * * * *